United States Patent [19]

Kenworthy

[11] Patent Number: 4,462,591

[45] Date of Patent: Jul. 31, 1984

[54] RACKET STRING FILAMENT

[76] Inventor: Charles A. Kenworthy, 18400 Ventura Blvd., Tarzana, Calif. 91356

[21] Appl. No.: 394,083

[22] Filed: Jul. 1, 1982

[51] Int. Cl.[3] ..... A63B 51/06

[52] U.S. Cl. ..... 273/73 D

[58] Field of Search ..... 273/73 R, 73 D, 73 L; 428/399, 400, 394, 397; 57/206, 248; 8/94.11

[56] References Cited

U.S. PATENT DOCUMENTS

| | | | |
|---|---|---|---|
| 3,926,431 | 12/1975 | DeLorean | 273/73 D |
| 4,005,863 | 1/1977 | Henry | 273/73 D |
| 4,238,262 | 12/1980 | Fishel | 273/73 D |

*Primary Examiner*—Richard C. Pinkham
*Assistant Examiner*—Matthew L. Schneider
*Attorney, Agent, or Firm*—Warren T. Jessup; Richard D. Slehofer

[57] ABSTRACT

A racket string filament having in cross-section a first face and a second face, formed back to back, is strung in the frame of a racket such that the first face is exposed only on one side of the racket and the second face only is exposed on the other side of the racket, thus forming a first uniform hitting surface on one side and a second uniform hitting surface on the other side. The hitting surfaces thus formed by the various faces cause a ball, when stroked, to form a trajectory which will be influenced greatly by the type of hitting surface used, and will impart spin or English to the moving ball. In one embodiment, the cross section of the first face is convex in shape and the cross section of the second face is flat or concave in shape.

5 Claims, 7 Drawing Figures

RACKET STRING FILAMENT

BACKGROUND OF THE INVENTION

Regulation tennis rackets are comprised of a handle having a frame at one end. Strings are strung in the frame such as to form a grid pattern where one row of strings would be in a uniformly spaced pattern and parallel to each other and perpendicular thereto would be another set of parallel strings which are spaced apart the same distance from one another. Furthermore, each string is grouped over and under each string it meets. This grid pattern produced creates more resilience toward the center or "sweet spot" in the racket frame. The regulation or traditional strung racket filament is circular in cross-section. As a result, both hitting faces of the racket will have identical playing characteristics.

The Delorean U.S. Pat. No., 3,962,431, shows a type of filament string which is triangular in cross-section and strung such that the apex of the triangle forms one face and the base of the triangle forms the other face of the racket. Furthermore, in Delorean the roughness or texture of one face can be altered. With this type of filament string, the hitting characteristics of the racket are different.

In Henry U.S. Pat. No. 4,005,863 the filament is square, hexagonal, triangular or oval in cross-section and the filaments are extruded in such a manner as to form a natural helix or twist to the filament in a natural manner. Again, the hitting surface as a result of these types of strings will markedly affect the playing characteristic of the racket.

SUMMARY OF THE INVENTION

The present invention seeks to produce a racket which has two hitting surfaces, one of which will be responsive in a standard manner as those described in the background, whereas, the second hitting surface will have different hitting characteristics. The racket string filaments are of a generally circular cross-section as is traditional; however, one part of the cross-section is sliced away, thus forming a generally cylindrical filament with one of its surfaces slashed away thus forming a planar surface along part of the circumference of a generally circular cross-section. The filament is strung such that the planar surface will always face one side of the hitting surface and thus form a uniform hitting surface, whereas the other side will have the circular cross-sectional shape for the traditional hitting surface of a racket. The tennis racket will be marked to indicate the traditional hitting surface versus the new surface. The edges formed where the new surface and the traditional surface meet have a definite effect on the flight characteristic of a ball when hit with the new surface. When a tennis ball makes contact with the grid of the racket, a deformation takes place with the ball as the surface of the ball wraps itself around the racket filaments. Because of this altered planar surface, and the two edges created thereby, the ball, through manipulation of the racket, can be made to form a unique trajectory or create a reverse spin or English on the ball. Thus, when the ball strikes the ground it will bounce with a certain characteristic.

Two further embodiments disclosed do not include the traditional circular surface. One is a rectangular shape and the other circular; both have planar cuts forming the first surface, and concave indentations forming the second face.

The purpose of the invention is to include a variety of cross-sections of a racket filament such that the player can elect which string filament functions best for his personal use, much in the same manner a golfer has several types of clubs or irons from which to select when hitting a golf ball.

DETAILED DESCRIPTION OF THE PREFERRED EMBODIMENT

Figure 1:
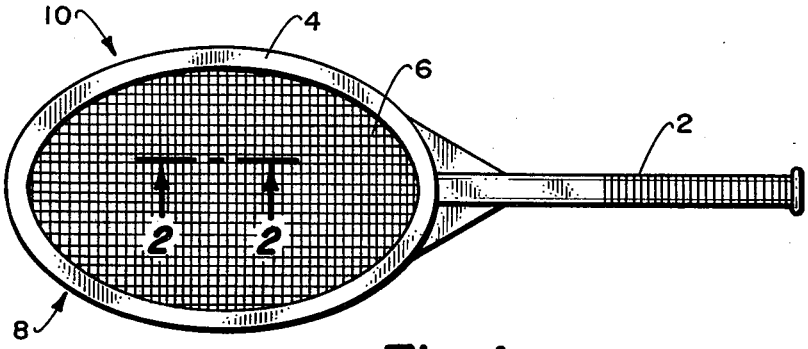
FIG. 1 is a top plan view of a racket showing the filament grid interlaced and spaced on the racket.

FIG. 1 shows a top plan view of a regulation-style racket having a handle 2 and a frame 4. Within this frame 4 is disclosed the grid of the filaments 6 when correctly threaded within the frame 4. The remaining FIGS. 2 through 7 indicate cross-sectional views of the filaments 6 along the line 2—2 of FIG. 1.

As disclosed in FIG. 1, there are two arrays of filament threads. One array is threaded parallel to the axis of the handle 2. Each thread is spaced equally distant from one another. The other array of filament threads are parallel to one another and run transversely to the axis of the handle 2. Again, this array of filament threads is spaced equally distant from one another. Each filament in the longitudinal array is interlaced with each filament in the transverse array, thus forming an interlacing grid which can be described as a first uniform hitting surface 8 forming one side of the racket and a second uniform hitting surface 10 on the other side of the racket.

According to the disclosure of this invention, the filaments have to be threaded and interlaced such that one face of the filament is always facing directly outwards from the first uniform hitting surface 8 and the other, or second, face of the filament is directly facing outwards from the second uniform hitting surface 10. This is easily accomplished by correctly threading each filament such that each face remains in its respective plane.

Figure 2:
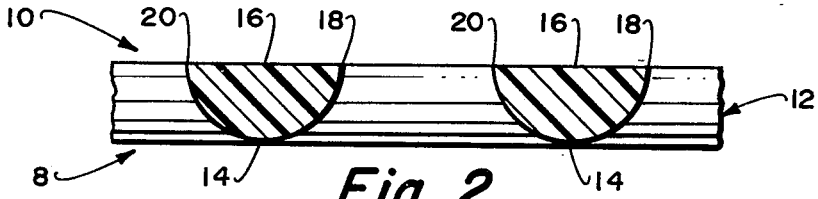
FIG. 2 is a cross-sectional view taken along line 2—2 of FIG. 1, indicating a cross-sectional view of a string filament indicating a half of the arc of a circle for the first face and a flat second face.

FIG. 2 discloses one embodiment of the invention generally disclosed as 12. The first face of the filament 12 is a secant of a circle in which the chord is the diameter of the circle stated otherwise, the surface or face 16 forms half of an arc on a circle. The second face 14 is the chord and thus forms a flat planar surface. The two surfaces 14 and 16 meet at edges 18 and 20. These two edges cause the "English" or spin whenever the ball is hit. This is also described as the second uniform hitting surface 10. The first uniform hitting surface 8 is the surface formed by the arc of the circle 14. This is the traditional part of the racket 2. The flat planar surface formed by the chord of the half circle forms the second face 16 which is the non-traditional second uniform surface 10. The edges where the first and second faces meet are important ball control factors which cause the ball, when hit, to develop certain flight characteristics, which is different from the traditional first hitting surface 8.

Figure 3:
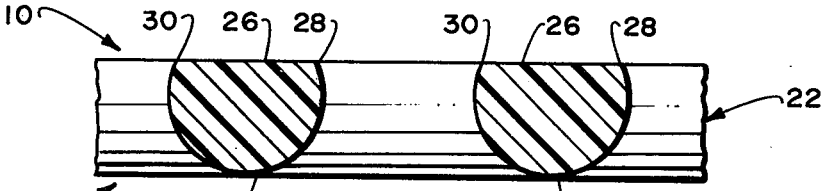
FIG. 3 is the same cross-section as in line 2—2 of FIG. 1, indicating a cross-section of a string filament showing a semi-circular first face and a flat second face.

FIG. 3 discloses a second embodiment designated as 22 of the filament. The first face 24 is a cross-section of a circle formed by a chord smaller than a diameter. The second face 26 is a plane formed by the chord intersecting the upper half of the filament. The edges where the first face 24 and second face 26 meet at 28 and 30 are again important factors in imparting a unique spin characteristic and flight pattern to the ball when struck with the second uniform hitting surface 10 created by the second face 26.

Figure 4:
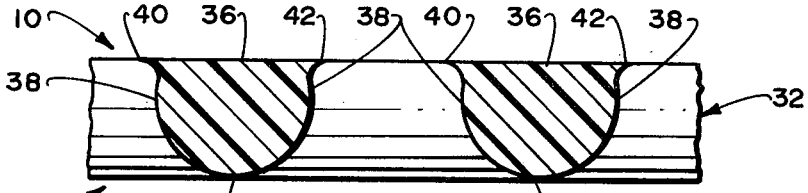
FIG. 4 is a cross-sectional view taken along line 2—2 of FIG. 1, the first face is a semi-circular formation forming fillets at the edges where the two faces meet, the second face being a flat face.

FIG. 4 discloses a third embodiment designated 32. The first face 34 is generally the one-half of the arc of a circle. The second face 36 is a planar surface. 38 is a fillet which flares out to form the two hitting edges 40 and 42. Here again the second hitting surface formed by the faces of 36 all interlaced in a uniform manner form a unique second hitting surface 10 which will cause a ball, when struck, to have a unique flight pattern and puts "English" on the ball.

Figure 5:
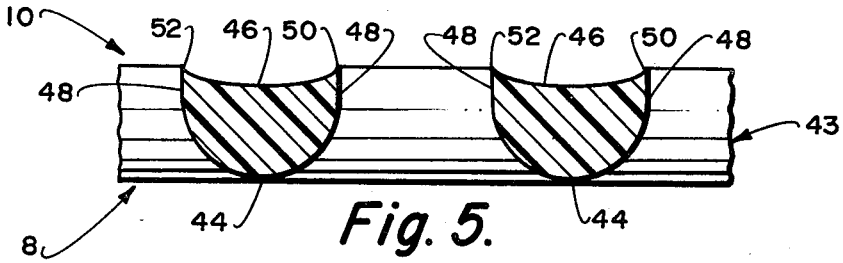
FIG. 5 is a cross-sectional view taken along line 2—2 of FIG. 1, showing a cross-sectional view of the string filament showing a convex first face forming extended tangential tips from the arced ends thereof, and a concave second face.

FIG. 5 generally designates the filament embodiment 43. The first face 44 is a half of the arc of a circle forming the first traditional face. The second face 46 is a slight concave groove instead of the planar surface as found in FIGS. 2, 3 and 4. The further modification of this embodiment indicates at 48 tangential extensions on both tips of the arc 44 going straight upwards when meeting the two edges 50, 52. Again, the two edges 50, 52 impart a given characteristic to the ball when struck.

The four embodiments disclosed in FIGS. 2, 3, 4 and 5 generally indicate a first traditional surface which is at least a half-circle in cross-section and laced in a uniform manner such that the first face 14, 24, 34 or 44 forms the first hitting surface 8. The ball when stroked on this surface will react in a traditional manner. The second faces 16, 26, 36, 46 forming the second hitting surfaces 10 will impart different spin characteristic and flight patterns of the ball. The racket can be identified such that the first hitting surface 8 will be marked by colors, numbers or the like, and the second hitting surface 10 can be also marked by colors, numbers, or the like, such that a player when desiring to have the ball act in a traditional manner will use the first hitting surface 8; whereas, when he or she wishes to impart certain unusual flight or spin characteristics to the ball, can use the second hitting surface 10.

Through trial and error the player could develop a preference for any particular second face or he could use the special rackets whenever the playing conditions warrant it.

Figure 6:
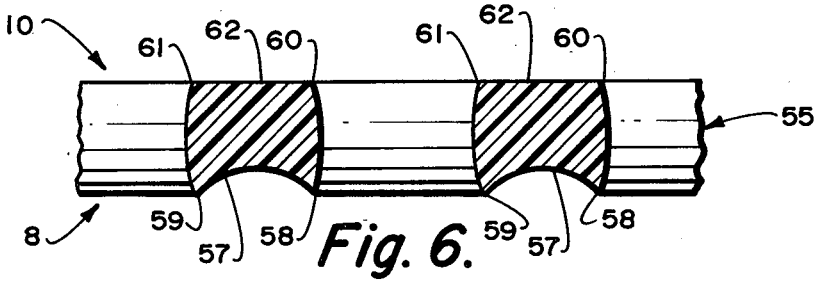
FIG. 6 is a cross-sectional view taken along line 2—2 of FIG. 1, showing a cross-sectional view of a string filament of a generally circular cross-section wherein the first face is grooved to form a concave surface, and the second face has a secant section removed to form a flat surface.
Figure 7:
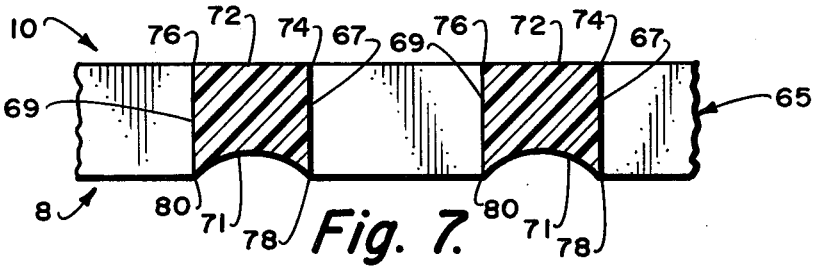
FIG. 7 is a cross-sectional view taken along line 2—2 of FIG. 1, showing a cross-sectional view of a modified string filament shown in FIG. 6 having secant sections removed from both sides of the generally round surface of the filament.

FIGS. 6 and 7 generally indicate slight modifications or differences from the first four embodiments as already disclosed. FIG. 6 will show another embodiment generally labelled as 55, showing a generally circular cross-section of a string filament with the further modification that the first face 57 is formed by a concave groove which is cut out along the axis of the filament 55. The second face, designated as 62, is a flat planar surface formed by the removal of a secant section of the filament. In this embodiment there are four hitting edges: 58 and 59 on the first hitting surface 8, and 60 and 61 on the second hitting surface 10. In this embodiment there will not be a traditional first hitting surface 8 because the concave first face 57 will change the hitting characteristic of the racket and the two leading edges 58 and 59 will also create different hitting characteristics. However, the second face 62 will have generally hitting characteristics analogous to those disclosed in FIG. 3, filament 22. So FIG. 6 could be considered to be a further modification of FIG. 3 by having the first face 24 with an added concave groove axially along the surface of the filament.

FIG. 7 is another filament generally designated as 65. The filament 65 is a modification of 55. Instead of having the two circular sides they are removed to form perpendicular sides, at 67 and 69. The first face 71 is generally a concave groove formed on the axis of the string filament. The second face 72 is a planar surface formed by the removal of a secant section on the filament. As indicated, the two side surfaces 67 and 69 are like FIG. 6 with the two secant sections removed, thus forming a generally three-sided rectangular surface 67, 72, 69, with one concave surface 71. Here again, there are four edges 74, 76 and 78, 80, which will impart unique characteristics to the ball when hit by either hitting surface 8 or 10.

The most economical method of manufacture for the racket filaments is through extrusion of a plastic material such as nylon or polyester. The cross-sectional shapes disclosed would be formed during the extrusion process and accordingly would not require any further machining or processing to create the faces or surfaces as disclosed.

Whereas the present invention has been shown and described herein in what is conceived to be the best mode contemplated, it is recognized that departures may be made therefrom within the scope of the invention which is therefore not to be limited to the details disclosed herein but is to be afforded the full scope of the invention.

What is claimed is:

1. A strung grid formed from racket string filament, said racket string filament having in cross-section a first face and a second face formed back to back, said filament being strung in two generally perpendicular directions such that said first face only is exposed on one side of the racket, said second face only is exposed on the other side of said racket, forming a first uniform hitting surface on one side of said racket and a second uniform hitting surface on the other side of said racket, the cross-section of said first face being a convex shape, the cross-section of said second face being a flat or concave shape.

2. The string as recited in claim 1 wherein said cross-section of said first face is more than a half circle.

3. The string as recited in claim 1 wherein a fillet is formed where said first face merges with said second face.

4. The string as recited in claim 1 wherein the section of the convex surface of said first face comprises a half-arc of a circle plus tangential extensions from both tips of the arc, said second face having a concave cross-section.

5. The string filament as recited in claim 1 wherein said filament is comprised of a plastic material.

* * * * *